United States Patent [19]

Gess

[11] 4,369,613

[45] Jan. 25, 1983

[54] APPARATUS FOR PRODUCING PACKAGES OF TWO WEBS OF VARYING LENGTHS AND WIDTHS

[76] Inventor: Larry C. Gess, 9270 Secor Rd., Temperance, Mich. 48182

[21] Appl. No.: 247,740

[22] Filed: Mar. 26, 1981

[51] Int. Cl.[3] ..... B65B 9/02; B65B 51/02; B65B 59/00

[52] U.S. Cl. ..... 53/553; 53/383; 156/548; 493/478

[58] Field of Search ..... 53/383, 553, 545, 546, 53/548; 493/220, 264, 266, 478, 479; 118/411, 412; 156/549, 548, 291, 107, 356, 357

[56] References Cited

U.S. PATENT DOCUMENTS

| | | | |
|---|---|---|---|
| 2,525,651 | 10/1950 | Clunan | 53/548 X |
| 2,737,002 | 3/1956 | Demler | 53/383 X |
| 2,737,860 | 3/1956 | Randall | 493/264 X |
| 2,931,148 | 5/1960 | Smith | 53/553 X |
| 3,020,687 | 2/1962 | Joa | 53/553 X |
| 3,168,016 | 2/1965 | Kehr | 53/450 |
| 3,234,705 | 2/1966 | Schwartz | 53/553 X |
| 3,508,378 | 4/1970 | Fehr et al. | 53/553 |
| 3,748,811 | 7/1973 | Cox | 53/450 |
| 3,831,342 | 8/1974 | Rejsa | 53/383 X |
| 4,064,792 | 12/1977 | Gess | 493/68 X |
| 4,244,158 | 1/1981 | Nelham | 53/450 X |
| 4,295,914 | 10/1981 | Checko | 156/357 |

FOREIGN PATENT DOCUMENTS

| | | | |
|---|---|---|---|
| 475160 | 7/1951 | Canada | 53/180 |

*Primary Examiner*—Nicholas P. Godici
*Assistant Examiner*—Charles L. Willis
*Attorney, Agent, or Firm*—Allen D. Gutchess, Jr.

[57] ABSTRACT

Packaging apparatus is provided for producing packages of various sizes. The package is of generally rectangular form and comprises two webs of packaging material which can be of a wide variety of lengths and widths. The packages have parallel longitudinal adhesive strips and parallel transverse adhesive strips joining the two webs of packaging material together. A lower continuous web of packaging material is fed longitudinally along a predetermined path and two separate applicator heads apply strips of adhesive material along edge portions of the web. Additional applicator heads, preferably combined as a single unit with two nozzles, apply transverse strips of adhesive material between the longitudinal strips when the web is stopped. After the object to be packaged is placed on the web in the area defined by the four adhesive strips, the second web of packaging material is applied over the first web and pressure means squeeze the two webs together along the four adhesive strips with the leading web portions then sheared to complete a package separated from the next package portion. The longitudinal applicator heads can be moved in and out relative to each other to provide packages of various widths and the stopping of the web and the application of the transverse adhesive strips can be controlled to vary the package length.

2 Claims, 11 Drawing Figures

APPARATUS FOR PRODUCING PACKAGES OF TWO WEBS OF VARYING LENGTHS AND WIDTHS

This invention relates to a package and to a packaging machine and method for producing generally rectangular packages of various lengths and widths from two webs of packaging material affixed together by adhesive strips.

While various packaging machines are known in the art, a packaging machine and method according to the invention are capable of producing generally rectangular packages of varying widths and lengths. The machine employs relatively simple controls by means of which the package size can be changed quickly to produce a desired size with minimum wasted set-up time. The machine also preferably employs hot melt adhesive with packaging materials which do not require cohesive coatings thereon, thereby resulting in less expensive packages.

The new machine employs a carriage which can be moved longitudinally of a bed of the machine. A first web of packaging material, such as conventional single-faced corrugated board, can be moved longitudinally along a bed of the machine with the carriage supporting first and second adhesive applicators along edge portions of the first packaging material web. These applicators can be moved in and out relative to each other and relative to a center line of the web to thereby determine the package width. Two additional applicator heads, preferably combined as a single unit, are supported by the carriage for transverse movement relative to the web, to apply transverse strips of adhesive thereto between the longitudinal strips. The carriage can be moved longitudinally relative to the bed of the machine to determine the position on the web on which the transverse strips are formed and the intervals at which the first web is stopped can also be controlled, thereby to control the length of the packages being formed.

The machine is also provided with pressure rolls for pressing together the two webs of packaging material at the longitudinal strips of adhesive after an object to be packaged is deposited on the first web within the area defined by the four adhesive strips and after the second web of packaging material is applied over the first web and the object thereon. Beyond the pressure rolls, the machine has a shear for shearing the leading package by severing the webs between the transverse strips, with the shear also being provided with pressure pads for applying pressure to the webs along the transverse adhesive strips during the shearing operation.

It is, therefore, a principal object of the invention to provide an improved packaging machine having the features and advantages discussed above.

Many other objects and advantages of the invention will be apparent from the following detailed description of a preferred embodiment thereof, reference being made to the accompanying drawings, in which.

Figure 1:
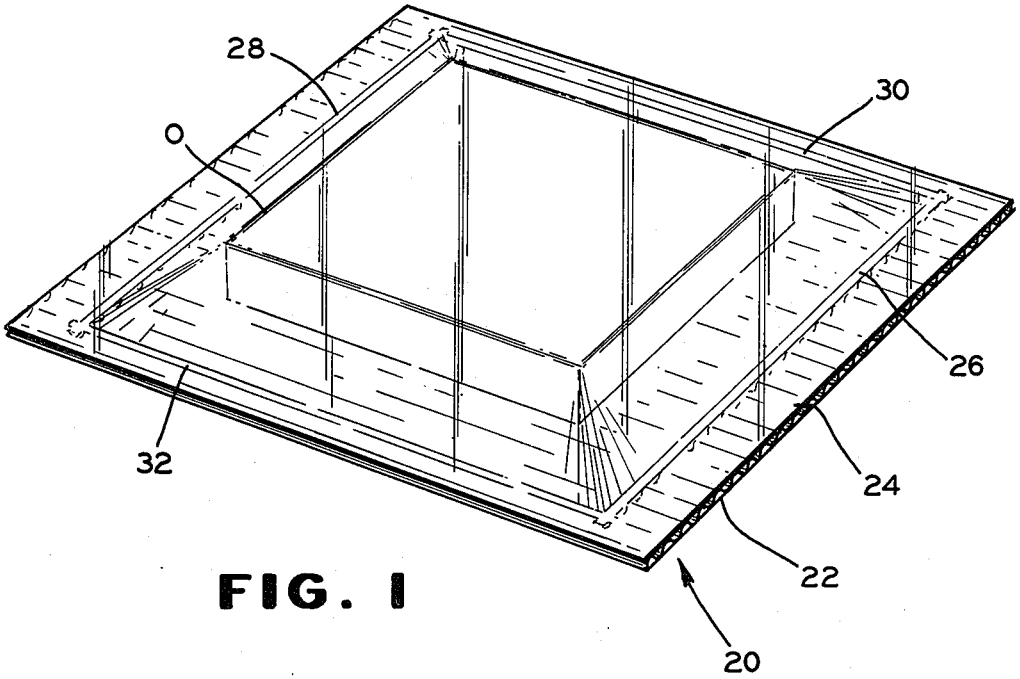
FIG. 1 is a view in perspective of a completed package according to the invention.

Referring to FIG. 1, a package in accordance with the invention is indicated at 20 and includes a lower sheet 22 of packaging material and an upper sheet 24 of packaging material between which is a packaged object O. The lower and upper sheets 22 and 24 are affixed together by longitudinal strips 26 and 28 or adhesive material and transverse strips 30 and 32 of adhesive material. In a specific form, the sheet 22 may be stiffer than the sheet 24 with the sheet 22 being of single-faced corrugated board having the corrugations facing upwardly and the sheet 24 being of clear plastic material. Most of the objects O to be packaged are generally of a somewhat flat nature, depending upon the degree of yieldability of the upper sheet 24. The adhesive material forming the strips 26, 28, 30, and 32 preferably is of the hot melt type but, in any event, the adhesive material eliminates the need for cohesive coated packaging sheets which are considerably more expensive than non-coated sheets. Depending upon the requirements, the sheets 22 and 24 can vary widely in width with the spacing of the longitudinal strips 26 and 28 of adhesive material varying accordingly. The length of the package can also vary widely, depending upon the spacing of the transverse strips 30 and 32 and the locations at which the sheets are sheared.

The package 20 is produced on the machine indicated at 34. Basically, the machine includes an adhesive-applying station 36 (FIG. 2) at which the longitudinal and transverse strips of adhesive material are applied and a pressing and shearing station 38 at which pressure is applied to the sheets 22 and 24 as the adhesive strips and the sheets are sheared. Objects to be packaged are deposited between the stations.

The machine 34 has a frame 40 and a bed 42. A first web 44 of packaging material which constitutes the lower sheets 22 is fed from a spool 46 at a forward end of the machine to the first station 36. The station 36 comprises a movable carriage or supporting housing 48 supported on the bed 42 by nylon blocks 50 or the like and guided for longitudinal movement relative to the bed 42 by side guides 52 (see FIG. 7 in particular). The carriage is moved longitudinally by suitable means. For this purpose, the carriage can have gear racks 54 extending longitudinally thereof and affixed to a lower surface of a base plate 45 of the carriage. The racks are engagable with spur gears 56 projecting upwardly through openings 58 in the bed 42. The spur gears 56 are affixed to a shaft 60 which is rotated by a central sprocket 62 driven by a motor 64. The operation of the motor 64 can be manually controlled to move the carriage back and forth relative to the bed 42 of the machine 34 to change the length of the package 20 being produced by changing the distance between the shearing station 38 and a transverse strip applicator, which will be discussed more fully subsequently.

Figure 3:
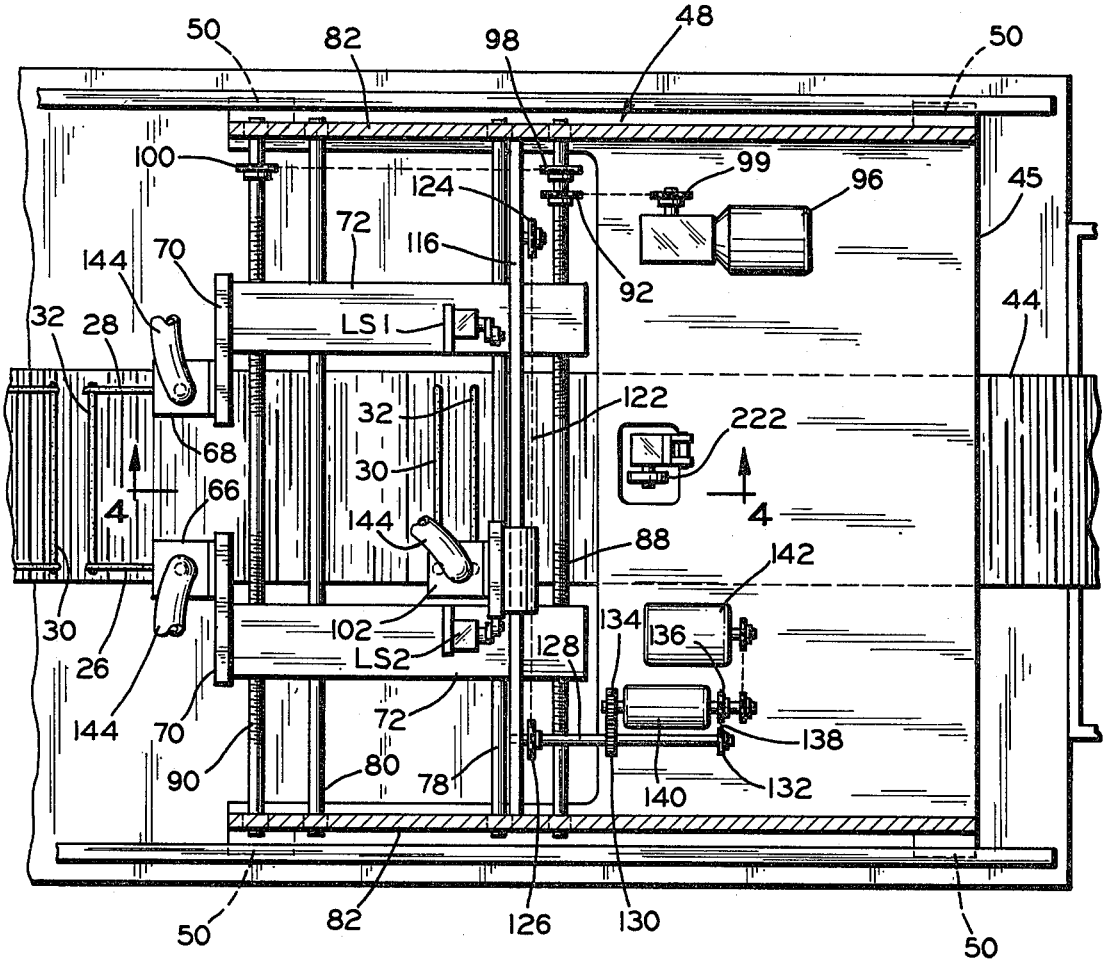
FIG. 3 is a fragmentary, enlarged view in horizontal cross section taken along the line 3—3 of FIG. 2.

As the first or lower web 44 moves along the machine bed 42 and under the carriage 48, the longitudinal strips 26 and 28 of adhesive are applied by applicators 66 and 68 (FIG. 3). These are commercially available and, when the adhesive material is a hot melt glue, the applicators can be obtained from Nordson Corporation of Amherst, Ohio. The applicators are mounted on plates 70 which are affixed to elongate supporting members 72 extending parallel to the web 44. The members 72 have depending bearing blocks 74 and 76 (FIG. 4) which receive transverse guide rods 78 and 80 which are supported by side walls 82 (FIGS. 3 and 4) of the carriage 48. The supporting members 72 also have threaded ears 86 and 88 (FIG. 4) which engage threaded rods 88 and 90. These rods move the supporting members 72 equal distances in and out relative to the web 44 and the center line thereof when the rods are rotated. For this purpose, the rods 88 and 90 have end portions which are oppositely threaded. The rod 88 has a sprocket 92 thereon which is driven by a drive sprocket 94 and a motor 96. When the rod 88 is turned, it turns the rod 90 an equal amount through sprockets 98 and 100. The supporting members 72 have limit switches LS1 and LS2 mounted at intermediate portions thereof and which move in and out therewith, the purpose of which will be discussed subsequently.

Figure 6:
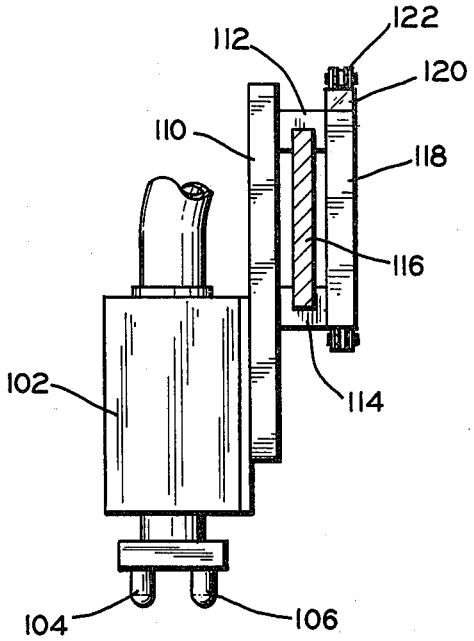
FIG. 6 is a view in transverse section taken along the line 6—6 of FIG. 5.

The transverse strips 30 and 32 of the adhesive material are applied to the web 44 by another commercially-available applicator 102 which, in this instance, has two nozzles 104 and 106 which are similar to nozzles 108 (FIG. 4) of the applicators 66 and 68 and which form the two transverse strips 30 and 32 of adhesive material simultaneously. The applicator 102 is mounted on a supporting plate 110 (FIG. 6) having U-shaped bearing blocks 112 and 114 affixed thereto and engaging edge portions of a slide bar 116 which extends across the carriage and is supported by the side walls 82. The sides of the guide blocks 112 and 114 opposite the plate 110 are affixed to a connecting plate 118 having a nylon bearing block 120 on the upper edge thereof.

Figure 5:
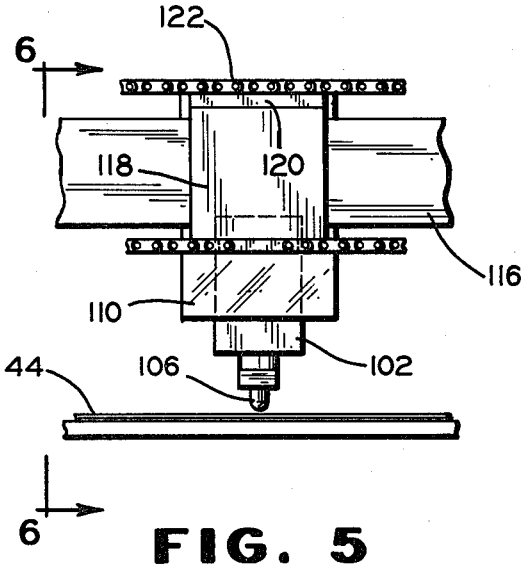
FIG. 5 is a fragmentary view in elevation of an adhesive applicator of the machine.

The applicator 102 and the attached supporting and bearing plates and blocks are moved along the slide bar 116 by a chain 122. The upper run on the chain 122 is slidably supported on the block 120 (see FIG. 5) and the lower run of the chain has ends affixed to a lower portion of the connecting plate 118. The chain has one portion engaged with an idler sprocket 124 (FIG. 3) while the other end portion of the chain is engaged with a drive sprocket 126. The drive sprocket 126 is mounted on a drive shaft 128 having a spur gear 130 and a sprocket 132 thereon. The spur gear 130 is engaged with a spur gear 134 and the sprocket 132 is connected with a sprocket 136 by a chain 138. The gear 134 and the sprocket 136 are connected through an electromagnetic clutch 140 to a motor 142. When the clutch 140 connects the motor 142 with the spur gear 134, the chain 122 is driven in one direction, and when the clutch 140 connects the sprocket 136 with the motor 142, the chain 122 is driven in the opposite direction.

The clutch and motor are controlled by the limit switches LS1 and LS2 so that when the applicator 102 engages one of the limit switches LS1 and LS2, the applicator is stopped until the web 44 advances a predetermind distance and stops once again, at which time the applicator 102 is moved in the opposite direction. Each time the applicator moves, it deposits the transverse strips 30 and 32 of adhesive material between the longitudinal strips 26 and 28 with the length of the strips 30 and 32 being controlled automatically by the positions of the limit switches LS1 and LS2 which, in turn, are controlled by the supporting members 72 and the spacing between the applicators 66 and 68.

When the adhesive is in the nature of a hot melt glue, the adhesive can be supplied to the applicators 66, 68, and 102 through flexible hoses 144 from a source or heated pot 146 located on the top of the carriage 48. The applicators have electrically-controlled, built-in valves to control the flow of adhesive through the nozzles 104–108.

After the web 44 has the longitudinal and transverse strips 26–32 of adhesive material applied thereto, it moves through a space between the stations 36 and 38 where the object O to be packaged is deposited on the web 44 within the area outlined by the strips 26–32. The web 44 then enters the station 38, where pressure is applied to the webs on the adhesive strips and the package 20 is sheared from the leading edge to complete the package.

Figure 8:
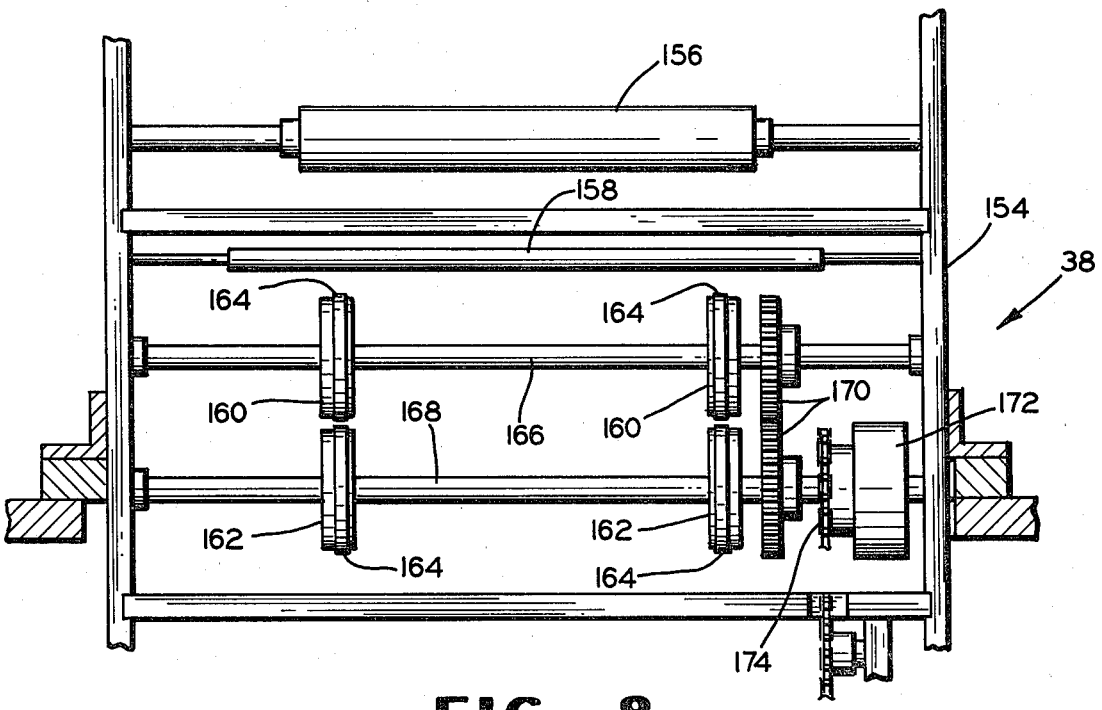
FIG. 8 is an end view of a pressing and shearing stand of the machine.

As the first web 42 with the adhesive strips and object thereon moves into the pressing and shearing station 38, an upper, second web 150 of packaging material constituting the upper sheets 24 of the packages 20 is deposited thereon. This web is supplied from a spool 152 (FIG. 2) mounted on a stand 154 of the station 38. The second web 150 is fed around two guide rollers 156 and 158 and into contact with the lower web 44 as the two webs move between upper and lower pressure rolls 160 and 162 (FIGS. 8 and 10) having resilient bands 164 on their peripheries. The rolls 160 and 162 are mounted for rotation on shafts 166 and 168 and can be longitudinally adjusted thereon so as to be in alignment with each other and with the longitudinal strips 26 and 28 of the adhesive material.

The upper rolls 160 and the lower rolls 162 are all driven and, in turn, move both the lower web 44 and the upper web 150 from their respective spools through the machine. The rolls can be driven through spur gears 170 (FIG. 8) and an electromagnetic clutch-brake 172 on the shaft 168. A sprocket 174 on the clutch-brake 172 is suitably driven through a motor 176 (FIG. 10) with the pressure rolls 160 and 162 driven and stopped by the clutch-brake 172.

Figure 9:
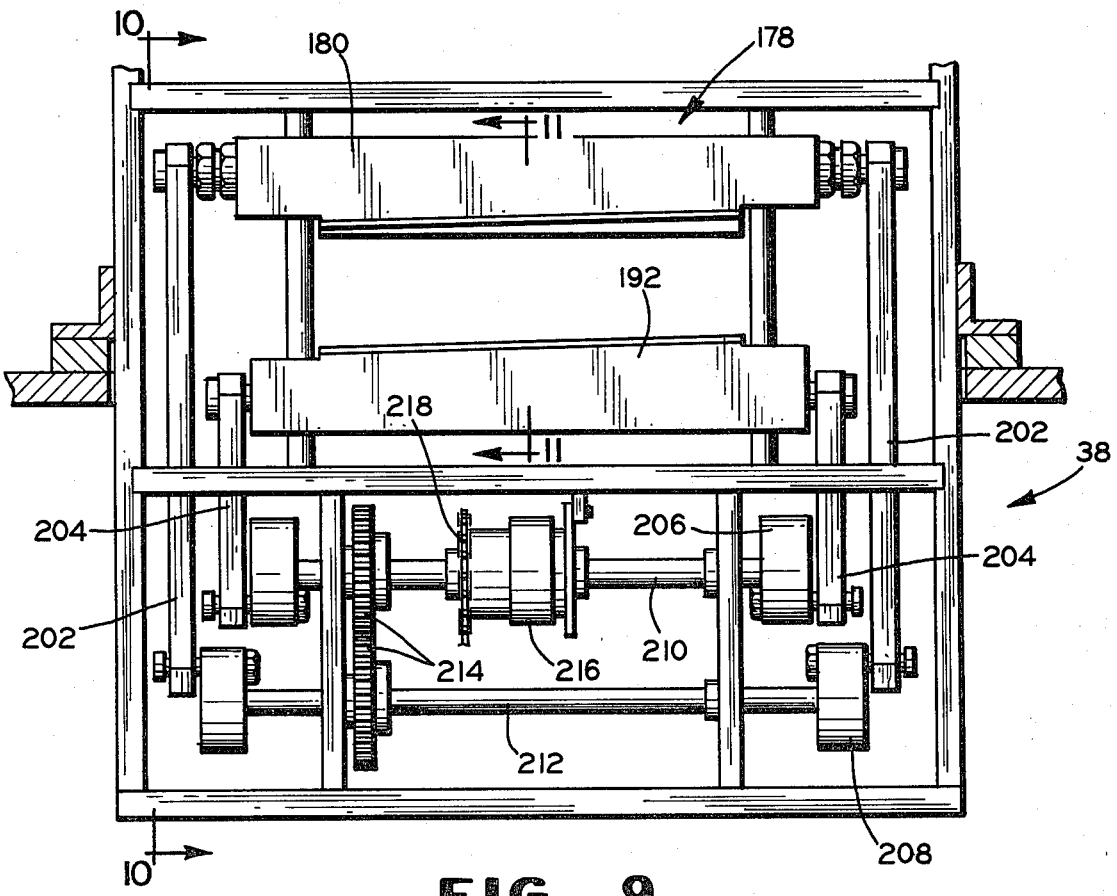
FIG. 9 is an opposite end view of the pressing and shearing stand of FIG. 8.
Figure 11:
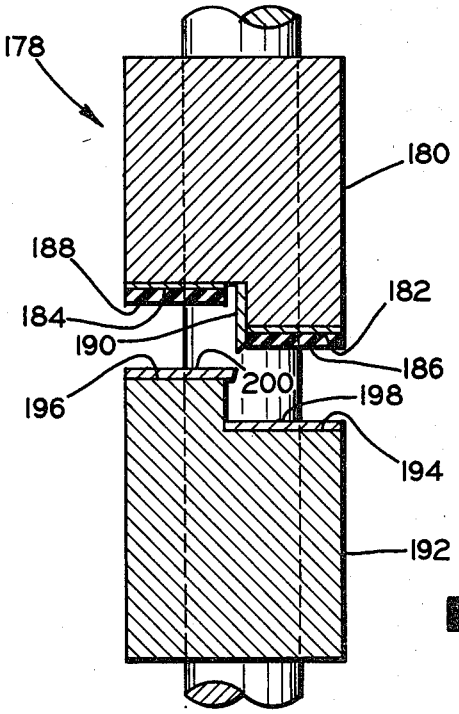
FIG. 11 is an enlarged view in transverse section taken generally along the line 11—11 of FIG. 9.

Beyond the pressure rolls 160 and 162, the webs move through a shear indicated at 178 in FIGS. 9 and 11. The shear includes an upper block 180 having two downwardly offset pressure surfaces 182 and 184 carrying resilient pressure strips 186 and 188 with a shear blade 190 being located between the strips.

The shear 178 also includes a lower block 192 having two offset pressure surfaces 194 and 196 with metal strips 198 and 200 thereon, the strip 200 constituting a shear blade cooperating with the blade 190. When the blocks 180 and 182 are moved together, the leading end portions of the webs 44 and 150 are severed to form the separate package 20. At the same time, the blocks apply pressure to the transverse adhesive strips 30 and 32 to form the ends of the packages. The transverse strips 30 are squeezed between the strips 188 and 200 while the transverse strips 32 are squeezed between the strips 186 and 198.

Figure 2:
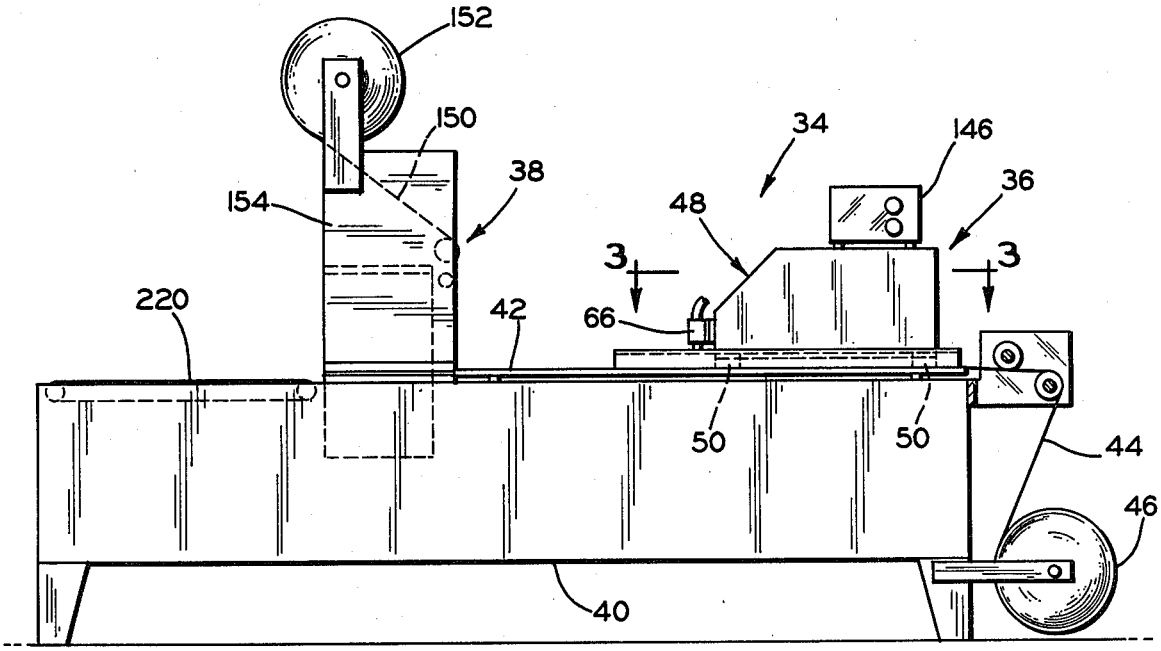
FIG. 2 is a schematic side view in elevation of a machine for producing the package of FIG. 1.
Figure 10:
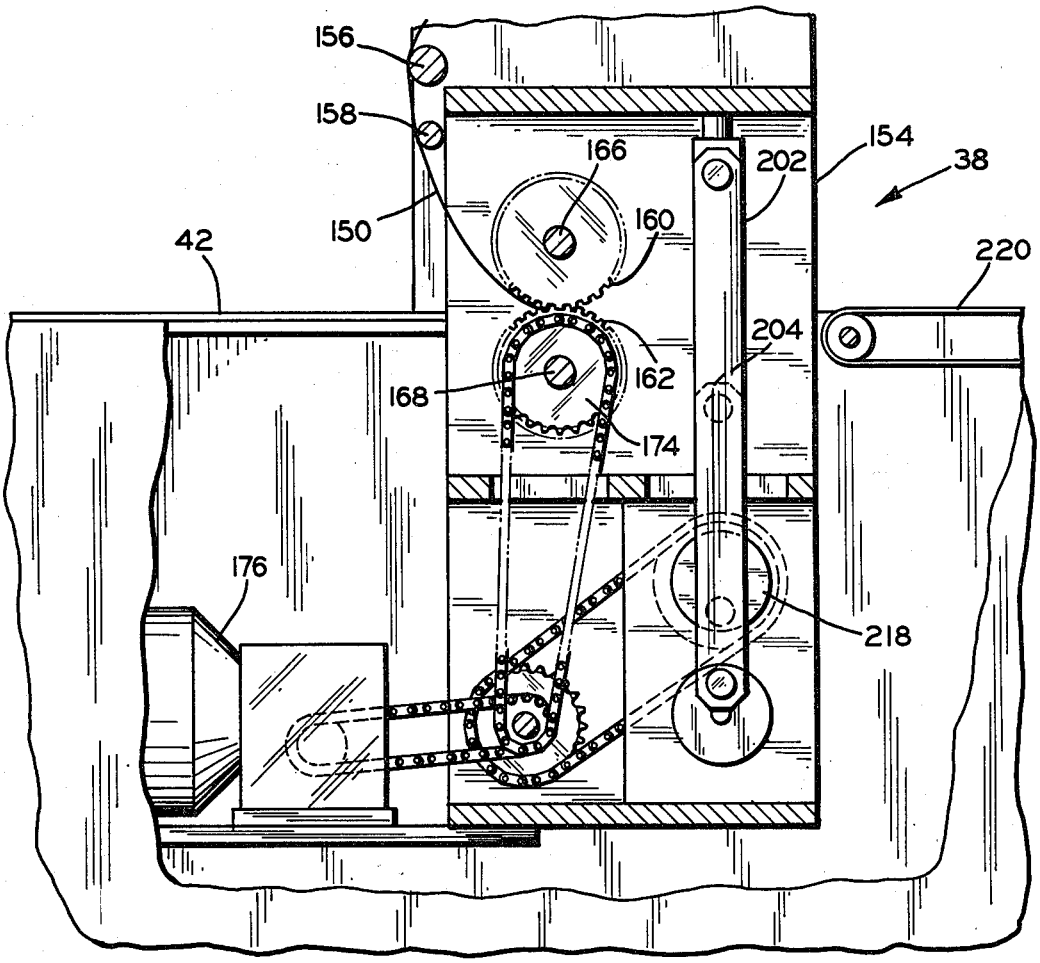
FIG. 10 is a view in section taken along the line 10—10 of FIG. 9.

The blocks 180 and 192 are driven toward and away from one another by links 202 and 204 (FIG. 9) connected by eccentrics 206 and 208 to shafts 210 and 212 which rotate together through spur gears 214. The shaft 210 is driven through an electromagnetic clutch 216 by a sprocket 218 which is also driven through the same motor 176 which drives the pressure rolls 160 and 162. More details of the pressing and shearing station 38 are set forth in my U.S. pat. 4,064,792, issued on Dec. 27, 1977. After the shearing operation, the finished package 20 can be carried off the machine by a discharge conveyor 220 (FIGS. 2 and 10).

Figure 4:
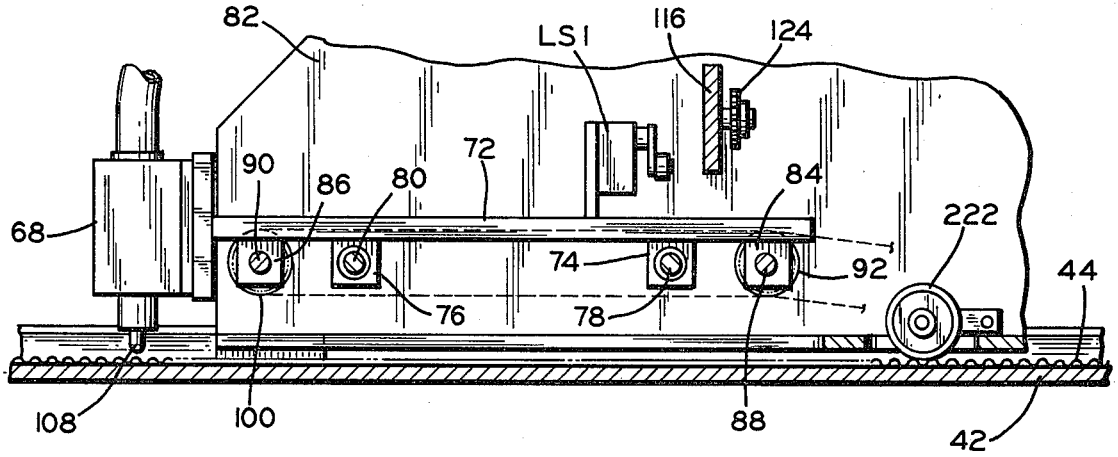
FIG. 4 is a fragmentary view in longitudinal cross section taken along the line 4—4 of FIG. 3.
Figure 7:
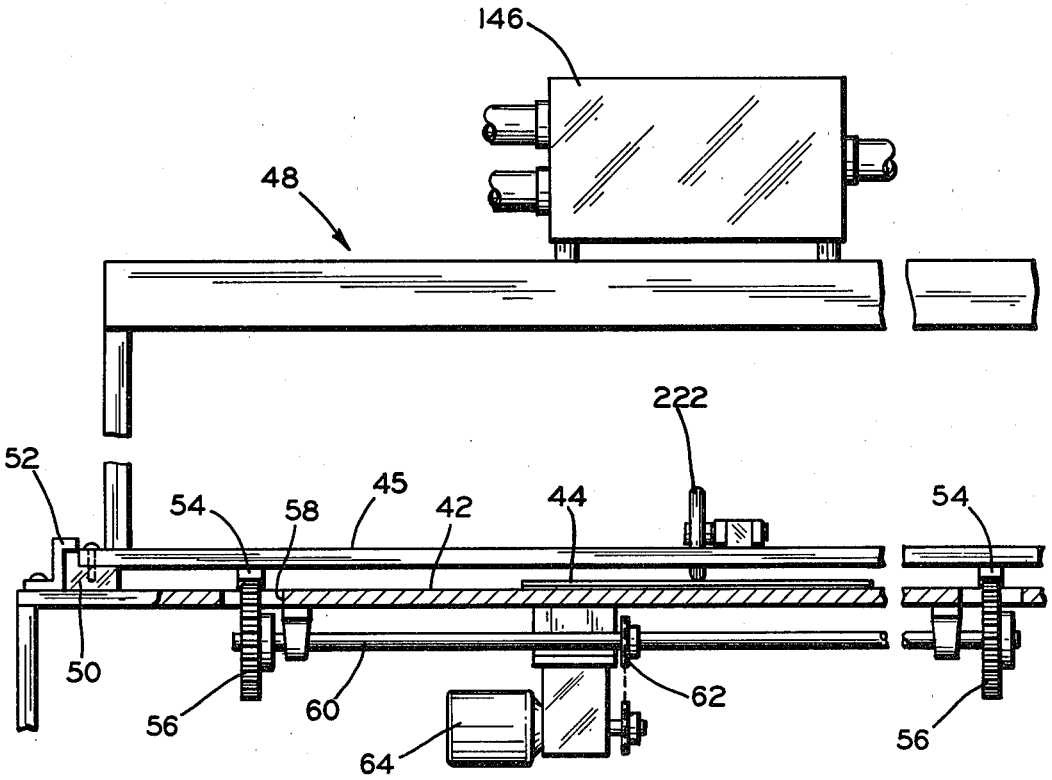
FIG. 7 is a fragmentary end view of a carriage of the machine.

A sensor 222 (FIGS. 3, 4 and 7 is mounted on the base plate 45 of the carriage 48 and is in contact with the web 44 and is rotated as the web moves lineally. The sensor 222 can control the operation of the machine and various components through microprocessors or by more conventional electrical components such as relays, etc. When the web 44 has advanced a predetermined length as sensed by the sensor 222, the advancement of the webs 44 and 150 is stopped. This is accomplished by actuating the electromagnetic brake-clutch 172 to disconnect the shaft 168 from the drive and apply the brake to stop the rolls 160 and 162. At that time, the electromagnetic clutch 216 is energized to move the shear blocks 180 and 192 together to shear the foremost package and to squeeze the transverse strips 30 and 32 on each side of the shear line. The valves of the applicators 66 and 68 are shut off and the valve of the applicator 102 is opened. At this time, the motor 142 is also energized and the clutch 140 is actuated in a manner to drive the applicator 102 in the desired direction to apply the transverse strips 30 and 32 of adhesive material between the longitudinal strips 26 and 28. The applicator 102 travels until the other limit switch is engaged, which stops the motor and readies the applicator for the next transverse trip across the web 44.

It may be noted that when the web 44 is stopped, the applicators 66 and 68 for the longitudinal adhesive strips are stopped at an intermediate portion of the length of the package. When the web 44 is advanced again, the applicator 66 and 68 also begin to apply the longitudinal strips again and continue to do so until reaching the first transverse strip 30 of adhesive. These applicators are then temporarily shut off until reaching the transverse strip 32 at which time they again deposit the longitudinal strips of adhesive until the web 44 stops once more, at which time the applicators are again at intermediate portions of the package length. With this arrangement, the valves of the applicators 66 and 68 are open for a fixed length of time to deposit a longitudinal strip equal to the distance between the applicator nozzles 108 and the first transverse nozzle 104 of the applicator 102. The valves of the applicators 66 and 68 then shut off for a sufficient time to form a gap equal to the distance between the nozzles 104 and 106 of the applicator 102. These applicator valves then open up again until the web stops, as selected for the package length and controlled by the sensor 222. Consequently, each time the longitudinal applicators 66 and 68 are started, they deposit longitudinal strips of fixed distances, then form gaps of fixed distances, and then deposit additional longitudinal strips of varying distances according to the package length desired.

Various modifications of the above-described embodiment of the invention will be apparent to those skilled in the art and it is to be understood that such modifications can be made without departing from the scope of the invention if they are within the spirit and the tenor of the accompanying claims.

I claim:

1. Apparatus for making a package comprising a bed having a flat surface, means for guiding and moving a first web of packaging material in a longitudinal path along said surface, a supporting housing positioned on said bed and supported on the bed on each side of the first web, a first applicator for depositing a first strip of adhesive material longitudinally along an edge portion of the first web, a second applicator for depositing a second strip of adhesive material longitudinally along another edge portion of the first web, means supporting said first and said second applicators by said supporting housing, means for depositing a first transverse strip of adhesive material on the first web between the longitudinal strips and for depositing a second transverse strip of adhesive material on the first web between the longitudinal strips, means for depositing a second web of packaging material on the first web, means for pressing the two webs together, and means for severing the webs between adjacent transverse strips, said means supporting said first and second applicators comprising a first supporting member for said first applicator and a second supporting member for said second applicator, means carried by said supporting housing for moving said first supporting member and said second supporting member toward and away from one another substantially equal distances, means for moving said transverse strip depositing means across the first web, and means carried by each of said supporting members for reversing the movement of said moving means when engaged by said transverse strip depositing means.

2. Apparatus according to claim 1 characterized by said reversing means comprising limit switches engagable by said transverse strip depositing means.

* * * * *